United States Patent [19]

Feldman

[11] 4,002,558

[45] Jan. 11, 1977

[54] REMOVING WATER HAZE FROM DISTILLATE FUELS

[75] Inventor: Nicholas Feldman, Woodbridge, N.J.

[73] Assignee: Exxon Research & Engineering Co., Linden, N.J.

[22] Filed: Jan. 22, 1976

[21] Appl. No.: 651,405

[52] U.S. Cl. ..... 208/188

[51] Int. Cl.[2] ..... C10G 33/04

[58] Field of Search ..... 208/188

[56] References Cited

UNITED STATES PATENTS

| | | | |
|---|---|---|---|
| 1,515,093 | 11/1924 | Crites et al. | 208/188 |
| 1,711,829 | 5/1929 | Boon | 208/188 |
| 2,324,955 | 7/1943 | Rupp et al. | 208/188 |
| 3,925,047 | 12/1975 | Harper | 208/188 |

*Primary Examiner*—George Crasanakis
*Attorney, Agent, or Firm*—Byron O. Dimmick

[57] ABSTRACT

Undesirable haze that occurs in a distillate fuel, such as a diesel fuel, a jet fuel or a heating oil, as a result of emulsion formation with slight traces of water, is removed from the fuel by adding to and simply mixing with the fuel a small amount of an inorganic halide or nitrate of calcium, magnesium, cadmium, copper or nickel dissolved in a water-miscible, fuel-immiscible aliphatic monohydric or polyhydric alcohol or glycol ether.

7 Claims, No Drawings

REMOVING WATER HAZE FROM DISTILLATE FUELS

BACKGROUND OF THE INVENTION

This invention concerns a method for removing undesirable haze from distillate fuels, such as diesel fuels, heating oils and fuels for jet aircraft. The haze, which results from the formation of a water-in-oil emulsion where only slight traces of water remain in the fuel, constitutes a frequent problem in the marketing of such fuels. There is always the danger that the water present in such haze, which may represent about 100 to 300 parts per million of water in the fuel, will coalesce in later storage and cause corrosion and operating problems, including ice formation under winter conditions. Also, even in those cases where the haze may not present any particular problem from the technical standpoint, i.e., it may not interfere with the practical use of the fuel, it is nevertheless objectionable from the marketing standpoint because of the undesirable appearance imparted to the fuel when the haze is present. It is almost impossible to prevent the formation of such haze because an aqueous phase exists in most fuel storage tanks as a result of moisture condensation from the venting atmosphere in the tank.

Briefly, in the practice of the present invention, a small amount of an inorganic salt, dissolved in a solvent comprising an aliphatic hydroxy compound that is well miscible with water but not miscible with a distillate fuel is added to and mixed with the hazy fuel, causing the haze to clear up much more rapidly than would occur by simply allowing the water to settle out of the fuel, the latter frequently taking much longer than could be practically tolerated.

REFERENCE TO THE PRIOR ART

It is known in the prior art to dehydrate hydrocarbons by contacting them with an aqueous solution of an alkali metal hydroxide as taught, for example, in U.S. Pat. No. 2,989,572 of O. H. Hariu et al which concerns the dehydration of liquid benzene with aqueous sodium hydroxide. It is also known to remove water from a mineral oil distillate, such as kerosene, by contacting it with an aqueous solution of a hygroscopic lithium salt or calcium salt, such as lithium bromide, lithium chloride, lithium nitrate or calcium chloride. This is taught in U.S. Pat. No. 2,674,562 of O. M. Elliott. U.S. Pat. No. 3,071,541 of R. W. Stenzel teaches removal of haze from petroleum oils by mixing them with a concentrated aqueous solution of monosodium phosphate and separating the mixture into an aqueous phase and an oil phase.

U.S. Pat. No. 3,560,173 of R. C. Coffey and R. L. Smith teaches the addition of from 1 to 10% of propyl alcohol to an aviation fuel to prevent the separation from the fuel of both dissolved and suspended water. The water is not removed from the fuel by this treatment but is merely kept from separating from the fuel.

DESCRIPTION OF THE PRESENT INVENTION

In the present invention, the separation of small percentages of water present in the form of an undesirable haze is accelerated by treating the fuel with a solution of a small amount of an inorganic salt dissolved in an aliphatic hydroxy compound whereby the separation of water that would frequently take much longer than could be practically tolerated can be effected in a very short period of time. The suitable aliphatic hydroxy compounds include methanol, ethanol, ethylene glycol and ethylene glycol monomethyl ether, all of which are well miscible with water but not with distillate fuels. The useful inorganic salts are the halides and nitrates of calcium, magnesium, cadmium, copper and nickel, and they include $MgCl_2$, $MgCl_2.6H_2O$, $CaCl_2$, $CaCl_2.2H_2O$, $CaCl_2.6H_2O$, $CdCl_2$, $CdCl.2\text{-}1/2H_2O$, $CuCl_2$, $CuCl_2.2\text{-}H_2O$, $Ni(NO_3)_2.6H_2O$. The haze clarification takes place regardless of whether or not the fuel contains any additives, such as antioxidants, flow improvers or others.

The solution of inorganic salt in monohydric or polyhydric alcohol or glycol ether can contain from 0.1 to 50 weight per cent of inorganic salt, based on the total weight of solution, and will more usually contain from about 5 to about 25 weight percent of the salt. Concentrations of 5 to 10 weight per cent are convenient to use.

The proportion of salt solution to fuel treated will range from about 0.002 to about 2 volumes of solution per 100 volumes of fuel, preferably about 0.04 to 0.5 volume of solution per 100 volumes of fuel.

Although the treatment of the fuel may in some cases require thorough mixing of the dehazing additive solution with the entire batch of the hazy fuel, in most instances very satisfactory results can be obtained merely by mixing the dehazing solution with from 0.5 to 2 volume percent of the batch of fuel and then simply pouring the resulting mixture into the balance of the fuel without any additional mechanical mixing. Also, entirely satisfactory dehazing can be obtained simply by spraying over the top of the body of fuel the entire quantity of dehazing solution that is to be used for treating that amount of fuel and then letting it settle through the fuel. Both of these procedures are of great practical value because a large number of fuel storage installations have no convenient means at hand for thorough mixing of added materials with the contents of the storage vessels.

The fuels that will be treated in accordance with this invention include jet fuels, diesel fuels, kerosene and heating oils. A representative heating oil specification calls for a 10% distillation point no higher than about 440° F and a 90% point of at least 540° F and usually no higher than about 650° F. See, for example, ASTM Specification D-396. A representative specification for No. 2-D diesel fuel includes a minimum flash point of 125° F and a 90% distillation point between 540° F and 640° F. See ASTM Specification D-975. Jet fuels generally have boiling ranges within the limits of about 150° to about 600° F. See U.S. Military Specification MIL-T5624-G, as well as ASTM Specification D-1655-59T.

The nature of this invention will be better understood when reference is made to the following examples.

EXAMPLE 1

To demonstrate the effectiveness of the salt solutions in the practice of the present invention, a water-in-oil emulsion was prepared by emulsifying 0.4 ml of water in 800 ml of a diesel fuel by pumping the mixture of water and fuel through a needle valve under a pressure of 40 psi. Portions of this emulsion were then shaken with a selected salt solution. The rate of break-up of the emulsion was then determined spectrophotometrically by measuring the amount of light transmitted through the sample at selected time intervals. In some cases, the fuel also contained an antioxidant or a flow improver to determine whether such additives would affect the rate of separation. The results that were obtained are shown in Table I which follows. The lower the percent of light transmittance, the hazier the fuel. With readings above about 93 to 94, the fuel usually appears clear to the naked eye.

TABLE I

| | % Light Transmittance After | | | | | |
|---|---|---|---|---|---|---|
| | O | 6 | 24 | 48 | 72 | 144 Hrs. |
| Diesel Fuel A | 46 | 54 | 66 | 84 | 97 | |
| "A". + 0.2 vol. % of 5 wt. % $MgCl_2.6H_2O$ in $CH_3OH$ | 65 | 97 | | | | |
| "A". + 0.2 vol. % of 5 wt. % $MgCl_2.6H_2O$ in $C_2H_5OH$ | 58 | 98 | | | | |
| "A". + 0.2 vol. % of 5 wt. % $MgCl_2.6H_2O$ in ethylene glycol | 66 | 97 | | | | |
| "A". + 0.2 vol. % of 5 wt. % $MgCl_2.6H_2O$ in ethylene glycol mono-methyl ether | 73 | 96 | | | | |
| "A". + 200 ppm ethylene-vinylacetate type flow improver ("B") | 39 | — | 60 | 77 | 100 | |
| "B" + 0.16 vol. % of 5 wt. % $MgCl_2.6H_2O$ in ethanol | 52 | — | 100 | | | |
| "B" + 0.16 vol. % of 5 wt. % $MgCl_2.6H_2O$ in ethylene glycol mono-methyl ether | 55 | — | 100 | | | |
| "B" + 42 ppm amine antioxidant ("C") | 33 | — | 40 | 53 | 69 | 89 |
| "C". + 0.16 vol. % of 5 wt. % $MgCl_2.6H_2O$ in ethylene glycol mono-methyl ether | 48 | — | 100 | | | |

Note:
"B" is Fuel A plus the flow improver;
"C" is Fuel A plus the flow improver and the antioxidant.

EXAMPLE 2

As in Example 1, a water-in-oil emulsion was prepared in a No. 2 domestic heating oil that contained 0.02 wt. % of an ethylene-vinyl acetate type of flow improver. The proportion of water to fuel was as in Example 1. The effectiveness of methanol solutions of magnesium chloride in treating the emulsion was determined in the manner described in Example 1, the results being shown in Table II which follows.

TABLE II

| | % Light Transmittance After | | |
|---|---|---|---|
| | 0 Hrs. | 24 Hrs. | 96 Hrs. |
| Heating Oil BHO | 42 | 59 | 81 |
| BHO + 0.06 vol % of 5 wt % $MgCl_2.6H_2O$ in $CH_3OH$ | 53 | 86 | 98 |
| BHO + 0.06 vol % of 10 wt % $MgCl_2.6H_2O$ in $CH_3OH$ | 59 | 97 | |
| BHO + 0.12 vol % of 5 wt % $MgCl_2.6H_2O$ in $CH_3OH$ | 70 | 96 | |

EXAMPLE 3

Inorganic salts other than magnesium chloride were also tested for their effectiveness in reducing haze, the salts being used in ethanol solutions. As in Example 1, a hazy emulsion was made with water in a No. 2 domestic heating oil similar to that of Example 2 using the same proportions of 0.4 ml of water in 800 ml of fuel. The results are given in Table III which follows. As in the previous examples, the salt concentrations are in weight percent, and the quantities of solution used are in volume percent.

TABLE III

| | % Light Transmittance After | | | | |
|---|---|---|---|---|---|
| | 0 | 24 | 48 | 72 | 96 Hrs. |
| Heating Oil K | 28 | 70 | 82 | 93 | |
| K + 0.1% of 5% $MgCl_2.6H_2O$ in $C_2H_5OH$ | 41 | 84 | 92 | | |
| K + 0.1% of 2% $Ni(NO_3)_2.6H_2O$ in EtOH | 41 | 89 | 93 | | |
| K + 0.05% ethylene vinyl acetate type flow improver ("L") | 21 | 32 | 38 | 50 | 58 |
| "L" + 0.1% of 5% $MgCl_2.6H_2O$ in EtOH | 31 | 78 | 87 | 98 | |
| "L" + 0.1% of 2% $Ni(NO_3)_2.6H_2O$ in EtOH | 30 | 80 | 84 | 94 | |
| "L" + 0.1% of 2% $CaCl_2$ in EtOH | 34 | 80 | 87 | 98 | |
| "L" + 0.1% of 2% $CdCl_2$. $2\frac{1}{2}H_2O$ in EtOH | 26 | 55 | 61 | 74 | 90 |

Note:
"L" is the Heating Oil K plus the flow improver.

COMPARATIVE EXAMPLES

A - Solvents Alone

The procedure of Example 1 was repeated using, in place of the salt solutions of Example 1, only the solvents without any inorganic salt being present. The data that were obtained are given in Table IV which follows.

TABLE IV

| | % Light Transmit. After Settling For | | | |
|---|---|---|---|---|
| | 0 Hrs. | 24 Hrs. | 48 Hrs. | 72 Hrs. |
| Base Fuel (Fuel "A") | 46 | 66 | 84 | 97 |
| 0.2% Methanol in Fuel "A" | 48 | 67 | 86 | 100 |
| 0.2% Ethylene Glycol in Fuel "A" | 52 | 69 | 87 | 100 |
| "A" + 0.2% Ethylene Glycol Monomethyl Ether | 53 | 69 | 82 | 97 |
| 0.2% Ethyl Alcohol in "A" | 48 | 60 | 73 | 92 |

Comparison of the data in Table I with the data in Table IV shows that the alcohols and glycols alone without the presence of an inorganic salt were not as efficient as the solutions of the inorganic salts in dehazing the fuel.

B - Effect of Solid Magnesium Chloride

Additional runs were made using the same procedure as above described wherein the effect of solid $MgCl_2.6H_2O$ alone was compared with that of a methanol solution of the salt. Runs were made in two separate heating oils, identified as No. 113 and No. 114. The results obtained, given in Table V, show that $MgCl_2.6Hl_2O$ dissolved in methanol was much more effective than the solid salt alone in removing the water haze from both fuels.

TABLE V

| | % Light Transmittance After | | |
|---|---|---|---|
| | 24 Hrs. | 48 Hrs. | 72 Hrs. |
| Base Fuel; No. 113 | 51 | 61 | 68 |
| 200 ml No. 113 treated with 0.02 g $MgCl_2.6H_2O$ dissolved in 0.2 ml methanol | 58 | 85 | 96 |
| 200 ml No. 113 treated with 0.05 g solid $MgCl_2.6H_2O$ | 48 | 62 | 77 |
| 200 ml No. 113 + 0.10 g solid $MgCl_2.6H_2O$ | 48 | 74 | 91 |
| | % Light Transmittance After | | |
| | 24 Hrs. | 48 Hrs. | 72 Hrs. |
| Base Fuel No. 114 | 74 | 81 | 90 |
| 200 ml No. 114 + 0.02 g $MgCl_26H_2O$ in 0.2 ml MeOH | 83 | 100 | |
| 200 ml No. 114 + 0.05 g Solid $MgCl_2.6H_2O$ | 71 | 83 | 91 |
| 200 ml No. 114 + 0.10 g Solid $MgCl_2.6H_2O$ | 72 | 89 | 97 |

Fuel 113 was a mixture of 66.5 volume percent of light catalytic cycle oil and 33.5 volume percent of heavy virgin naphtha and had an initial boiling point of 292° F, a 50% point of 491° F and a final boiling point of 642° F. Fuel 114 was a mixture of 66.5 volume percent of light catalytic cycle oil and 33.5 volume percent of water-white diesel fuel. It had an initial boiling point of 344° F, a 50% point of 510° F and a final boiling point of 650° F. Each fuel contained 30 ppm of an antioxidant comprising mixed monomethyl and dimethyl cyclohexylamines. Fuel 113 also contained 200 ppm of an ethylene-vinyl acetate type of flow improver.

What is claimed is:

1. A method for removing water haze from a middle distillate fuel which comprises contacting said fuel with from 0.002 to 2 volumes per 100 volumes of said fuel, of a solution of an inorganic halide or nitrate of calcium, magnesium, cadmium, copper or nickel dissolved in a water-miscible, fuel-immiscible aliphatic monohydric alcohol, polyhydric alcohol or glycol ether, said solution containing from 0.1 to 50 wt. % of said inorganic halide or nitrate.

2. The method of claim 1 wherein said solution comprises magnesium chloride dissolved in methanol.

3. The method of claim 1 wherein said solvent is selected from the group consisting of ethanol, methanol, ethylene glycol and ethylene glycol monomethyl ether.

4. The method of claim 1 wherein there is used from about 0.04 to about 0.5 volume of solution for 100 volumes of fuel.

5. The method of claim 1 wherein said solution contains from about 5 to about 25 wt. % of said inorganic halide or nitrate.

6. The method of claim 1 wherein the total quantity of solution employed in treating a batch of fuel is premixed with from 0.5 to 2 volume percent of the fuel and the resulting mixture is then simply poured into the remaining bulk of the fuel without any additional mechanical mixing.

7. The method of claim 1 wherein the total quantity of solution employed in treating a batch of fuel is sprayed over the top surface of the batch of fuel and permitted to settle through the fuel without mechanical stirring or mixing.

* * * * *